US005145440A

United States Patent [19]

Boris et al.

[11] Patent Number: 5,145,440

[45] Date of Patent: Sep. 8, 1992

[54] INFLATABLE LIFESIZE TOY STRUCTURE WITH INTERLOCKING ELEMENTS

[76] Inventors: Sherri M. Boris, 290 W. 2nd Ave., Sun Valley, Nev. 89434; Joseph F. Boris, Sr., 10297 Peninsula Dr., Stanwood, Mich. 49346

[21] Appl. No.: 588,579

[22] Filed: Sep. 24, 1990

[51] Int. Cl.[5] ..... A63H 33/03

[52] U.S. Cl. ..... 446/106; 446/85

[58] Field of Search ..... 52/2 K, DIG. 13; 446/85, 106, 220, 221, 901

[56] References Cited

U.S. PATENT DOCUMENTS 2,059,598 11/1936 Paulson ..... 446/85 X
3,137,967 6/1964 Flicth .
3,613,292 10/1971 Schilling .
3,626,634 12/1971 Jones .
3,676,276 7/1972 Hirshen et al. ..... 446/220 X
3,994,102 11/1976 Johnson et al. ..... 52/2 K
4,197,681 4/1980 Holcombe ..... 52/DIG. 13 X
4,521,203 6/1985 Rothenberg .
4,877,044 10/1989 Cantwell et al. ..... 52/DIG. 13 X

*Primary Examiner*—Robert A. Hafer
*Assistant Examiner*—Sam Rimell

[57] ABSTRACT

A life size toy play structure constructed of inflatable elements. Each of said elements has a recess or notch allowing for the interlocking of each element one with another, thus enabling the construction of life size toy structures by children without tools, fasteners, or adhesives. The elements of the play structure are a soft vinyl plastic making the entire structure safe for children to build and play with indoors or outdoors. When not in use, the elements of the play structure are deflated and stored in a relatively small container.

1 Claim, 2 Drawing Sheets

Fig 1
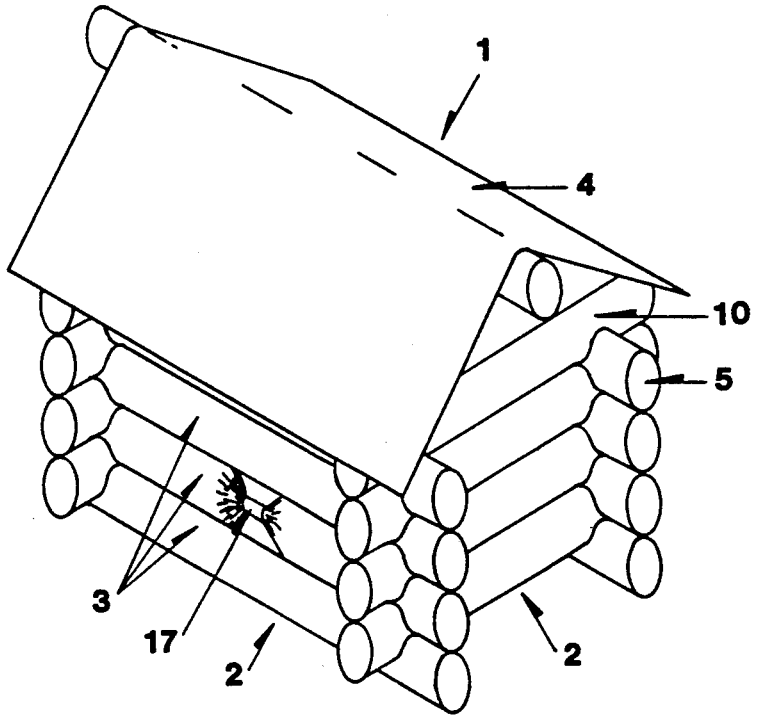
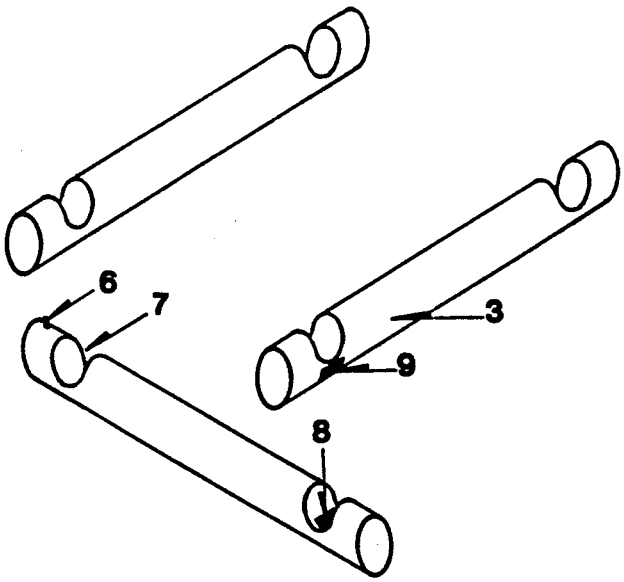
Fig 2

INFLATABLE LIFESIZE TOY STRUCTURE WITH INTERLOCKING ELEMENTS

BACKGROUND OF THE INVENTION

1. Field Of Invention

This invention relates to toy structures, and more particularily to life size toy structures capable of being readily erected by children. More specifically, the invention relates to novel building components for the construction of life size toy playhouses.

Among the most enjoyable pastimes for children is playing in life size toy structures. Conventional life size play structures are assembled from bulky, hard, heavy, cumbersome, and dangerous materials such as wood, cardboard, hard plastics or other materials not easily manipulated by children. Also, conventional life size play structures may require the use of tools, nails, adhesives or other fasteners to hold together the heavy elements that these play structures are constructed of, which will require the supervision of an adult. The building components of conventional life size knockdown toy structures take up a large volumn of space in relationship to the erected toy structure, and when the building components are stored, a volumnous area specifically for their storage is required.

The present invention is a safe, lightweight, easily stored and educational life size knockdown toy structure composed of self interlocking inflatable components, all of which are for the relative ease in the construction of toy structures by children without the need of adult supervision.

2. Description Of Prior Art

Life size toy structures are known in the arts. U.S. Pat. No. 3,137,967 discloses a knockdown life size toy structure that is also a puzzle. U.S. Pat. No. 3,513,292 discloses a means of storing the bulky elements of a life size toy structure. U.S. Pat. Nos. 3,626,634 3,676,276, 3,994,102, 4,197,681 discloses a means of incorporating inflatable elements in the construction of life size play structures. U.S. Pat. No. 4,521,203 discloses a life size toy structure that addresses the problem of heavy building components in life size toy structures. U.S. Pat. No. 2,059,598 discloses a miniature log cabin construction toy, U.S. Pat. No. 4,877,044 discloses a means of releasably attaching a tent pole to a tent and to another tent pole.

SUMMARY OF THE INVENTION

It is an object of the present invention to provide ease in manipulation of life size toy building components by children. The novel components of this invention are inflatable and therefore easily manipulated by children because the components are made of a soft vinyl plastic material that is light in weight.

It is another object of this invention to provide a means of interlocking the inflatable building components one with another, so that a life size inflatable toy structure can be readily erected by children without the need for tools, fasteners, or adhesives. This object is accomplished through interlocking notches in the building components of this invention, such that the building components can be stacked and interlocked vertically for the construction of playhouse walls and roofs.

Another object of this invention is to provide for ease in storage of the disassembled life size toy structure. This object is accomplished because the components of the present invention are deflatable, thus the components are stored in a relatively small area.

Another object of the present invention is to provide for a life size play structure that can be utilized safely indoors as well as outdoors. This object is accomplished by using inflatable light weight building components for the construction of the life size toy structure of the present invention.

Another object of the present invention is to help in the development of various intellectual traits of children. This object is accomplished due to childrens' ease in the manipulation of the light weight building components and the components' self interlocking features. Adult assistence and supervision is not required in the construction of the play structure according to the present invention, thereby allowing for the child to build a variety of life size play structures, furthering the development of the childs' imagination, confidence and self esteem.

DRAWING FIGURES

FIG. 1 is a perspective view of a life size knockdown inflatable toy playhouse according to the invention.

FIG. 2 is an exploded perspective view showing the interlocking means of several inflatable constuction elements comprising the toy playhouse.

DRAWING REFERENCE NUMERALS

Figure 3:
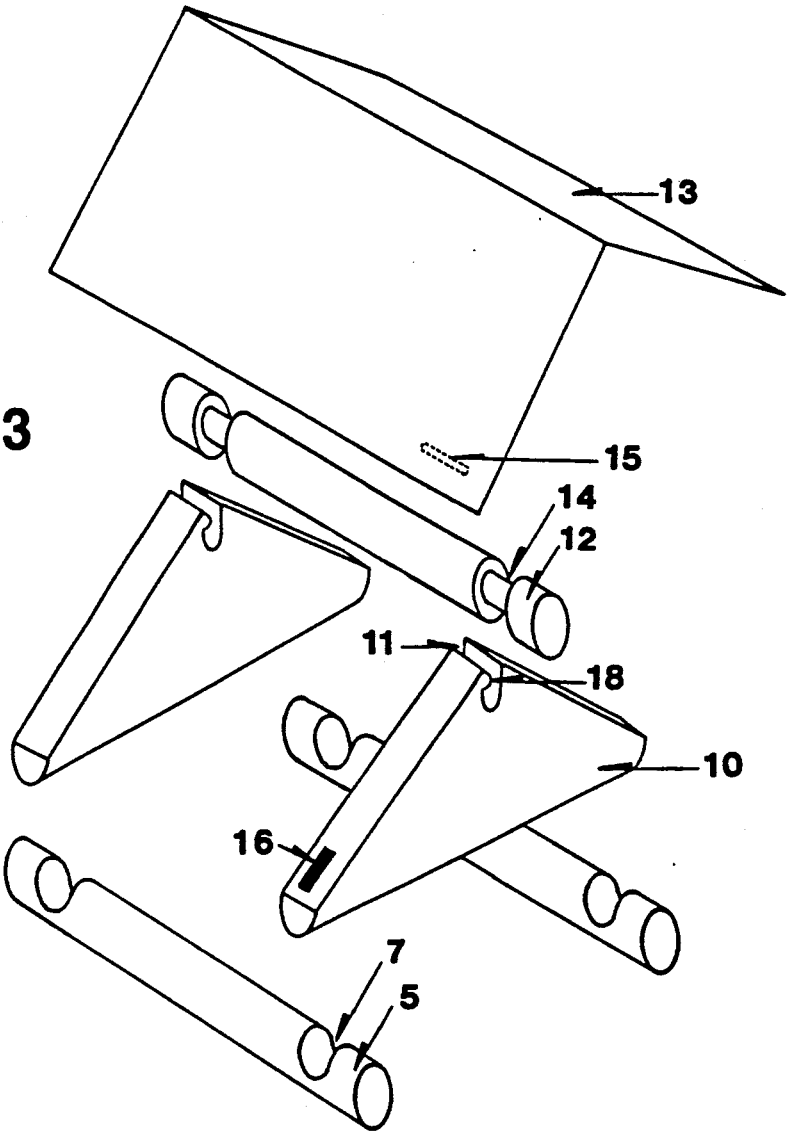
FIG. 3 is an explode perspective view of the roof unit of the toy playhouse.

1 erected inflatable life size playhouse
2 playhouse walls
3 playhouse constructing elements
4 playhouse roof
5 topmost elements of playhouse walls
6 air valve
7 constructing element notch
8 velcro in notch
9 velcro on constructing element
10 inflatable truss
11 truss notch
12 inflatable ridge board
13 roofing
14 ridge board notch
15 velcro on roofing
16 velcro on truss
17 window forming element
18 tabs of notch 11

DETAILED DESCRIPTION OF THE INVENTION

FIG. 1 illustrates a life size knockdown toy structure 1 which is constructed from individual inflatable constructing elements 3 whereby the elements 3 are stacked vertically and interlocked with like perpendicular elements 3 creating walls 2 of the structure 1. The toy structure 1 has a roof assembly 4 constructed in part of individual inflatable truss elements 10 that interlock with the top most wall elements 5 of opposing structure walls 2.

Referring to FIG. 2, each inflatable constructing element 3 is fabricated from an elongated tubular body of a vinyl plastic that forms an enclosed gas chamber within, and having an air valve 6 for the inflation and deflation of the inflatable construction elements. The element 3 is formed adjacent its opposed free ends with inwardly directed notches 7. The notches 7 are lined with velcro material 8 and, when mated with the underside of an element 3 lined with velcro material 9, the notches 7 are employed as the interlocking means of the elements 3. By way of the perpendicular alternate stacking of the elements 3, walls 2 of the toy structure 1 are erected in a well known manner. Elements 3 of the walls 2 are interlocked within at least one notch 7 of another element 3 thus reducing lateral movement of individual elements 3, and providing for a knockdown life size toy structure which doesn't require fasteners, adhesives or tools for its construction.

Referring to FIG. 3, inflatable truss elements 10 are fabricated from elongated plastic vinyl tubular bodies welded together to form an enclosed gas chamber. A notch 11 is formed at the peak of the truss 10 for the fitting into of an inflatable ridgeboard element 12. The ridgeboard 12 has adjacent its opposed free ends notches 14, which are flutes, so that when a notch 14 is fitted into a notch 11, tabs 18 at the top opening of the notch 11 enclose and lock the ridgeboard 12 to the truss 10. Roofing 13, fabricated from a vinyl plastic sheet imprinted with a shingle design, is fitted over a ridgeboard 12 locked by way of the notches 14 fitted into the notches 11 of two truss elements 10 to form the roof of the play structure of the invention.

Figure 4:
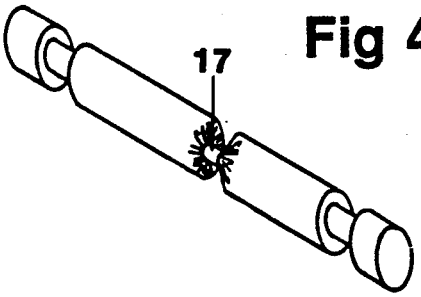
FIG. 4 is a view showing the element which is the means of inserting windows into any wall of the toy playhouse.

Referring to FIG. 4, a window forming element 17 is inserted over one or more constructing elements 3, permitting the entry of ambient air and light through the walls 2 and into the erected toy structure 1.

The entire toy structure 1 may be as readily disassembled and deflated, and the elements thereof stored in a very small space in relation to the inflated toy structure 1.

Various modifications are contemplated and may obviously be resorted to by those skilled in the art without departing from the spirit and scope of the invention, as herein defined by the appended claims, as only a preferred embodiment has been disclosed.

What is claimed is:

1. A toy construction kit for erecting structures large enough to be played in by children comprising:

a plurality of inflatable elements, said elements forming a cylendrical shape in the elongated direction, said elements being generally round in cross section, said elements constructed of flexible walls and having two sealed ends forming an enclosed gas chamber within;

said elements having at least one air valve as a means of inflation and deflation of said elements;

said elements having at least one convex recess thereof inclined inwardly from said flexible exterior of said element toward the interior of said enclosed gas chamber whereby a symmetrical half circle is formed of an approximate diameter of said element, said recess having an axis that is perpendicular to the axis of said element, said recess being a means of the perpendicular coupling of one said element with another said element;

said elements stacked vertically one with another in a perpendicular alternating pattern whereby each stacked element is seated into said recess of an adjacent perpendicular element thereby interlocking each perpendicular adjacent element, one with another;

a ring element, said ring element being less in diameter than the diameter of the cross section of said element, is a means for forming a window in a wall of said toy structure.

* * * * *